United States Patent [19]

Matsushita et al.

[11] Patent Number: 4,811,045

[45] Date of Patent: Mar. 7, 1989

[54] ELECTROSTATIC IMAGE FORMING APPARATUS

[75] Inventors: Kouji Matsushita, Toyokawa; Hidekazu Nakagami, Toyohashi; Nobuaki Nishioka, Toyokawa; Tatsumi Makio, Toyohashi, all of Japan

[73] Assignee: Minolta Camera Kabushiki Kaisha, Osaka, Japan

[21] Appl. No.: 19,654

[22] Filed: Feb. 27, 1987

[30] Foreign Application Priority Data

Mar. 11, 1986 [JP] Japan ..... 61-51455

[51] Int. Cl.[4] ..... G03G 15/00

[52] U.S. Cl. ..... 355/3 CH; 355/14 CH; 355/14 R; 430/902

[58] Field of Search ..... 355/3 CH, 14 CH, 14 D, 355/3 TR, 14 TR, 14 E, 3 DD, 3 R, 14 R; 430/902

[56] References Cited

U.S. PATENT DOCUMENTS

| | | | |
|---|---|---|---|
| 4,141,648 | 2/1979 | Gaitten et al. | 355/14 TR X |
| 4,251,152 | 2/1981 | Miyakawa et al. | 355/3 R |
| 4,265,998 | 5/1981 | Barkley | 355/3 CH |
| 4,315,685 | 2/1982 | Inuzuka et al. | |

*Primary Examiner*—A. T. Grimley
*Assistant Examiner*—Edward Pipala
*Attorney, Agent, or Firm*—Burns, Doane, Swecker & Mathis

[57] ABSTRACT

An improved electrostatic image forming apparatus including a controller for controlling the supplied voltage on the grid electrode of the main charger which gives the charges on the photosensitive member. Voltage on the grid electrode is controlled so that the charged potential on the photosensitive member may be held virtually at zero potential after the completion of the image forming operation until the predetermined time.

5 Claims, 4 Drawing Sheets

CHARGING

EXPOSING

DEVELOPING

TRANSFERRING

ELIMINATING BY AC CHARGE-ELIMINATOR

ERASING BY ERASING LAMP

CHARGING

GRID OF MAIN CHARGER IS GROUNDED

CHARGING BY TRANSFER CHARGER

TRANSFER CHARGER OFF

ELIMINATING BY AC CHARGE-ELIMINATOR

AC CHARGE-ELIMINATOR OFF

ERASING BY ERASING LAMP

ERASING BY GROUNDED GRID OF MAIN CHARGER

ELECTROSTATIC IMAGE FORMING APPARATUS

BACKGROUND OF THE INVENTION

1. Field of the Invention

The present invention relates to an electrostatic image forming apparatus, and more particularly to a charge control device for the photosensitive member in the image forming apparatus.

2. Description of the Prior Art

The means for image formation by the electrostatic method, in which an electrostatic latent image is formed on a photosensitive member, the image is developed with toner and then transferred to recording paper and fixed thereon, and a visible image is thereby produced, is widely employed for copying machines, laser printers, and so on.

In such electrostatic image forming means, if electrical charging is applied to the photosensitive member in reverse polarity to that of the main charging therefor which depends on the characteristic of the photosensitive member (the main charging is meant the charging of negative polarity when the photosensitive member is of P-type semiconductor, or the charging of positive polarity when the photosensitive member is of N-type semiconductor), then, it causes difficulty in applying the main charges onto the photosensitive member in the charging operation of next time, unless the charges are erased in a short time. The difficulty is likely to produce bad effects such that fogs or the like appear in the formed image, as will be discussed later, when reverse development is practiced.

In the case of reproduction of a positive image from an original of a positive image, i.e., the positive-to-positive image formation, as is the case with the ordinary electrophotographic copiers, such procedure is taken that electrical charges for the main charging are first applied onto the photosensitive member, the same is exposed to the optical image from the original and an electrostatic latent image is thereby formed on the same, the electrostatic latent image is then developed with toner having electrical charges of reverse polarity to that of the charges for the main charging, and then the toner image is transferred onto recording paper while charges of the same polarity to that of the charges for the main charging are given thereto by a transferring charger.

Therefore, charges of the reverse polarity will never be left on the photosensitive member and hence any particular problem is caused.

However, if the same steps as described above are taken in the case of forming a positive image on recording paper from the image exposed on a photosensitive member by laser beam or forming a positive image reproduction from a microfilm having a negative image, the toner will not adhere to the exposed portion of the photosensitive member but rather adheres to the unexposed portion thereof. Accordingly the obtained image transferred onto recording paper becomes a negative image.

In a negative-to-positive image formation to provide a positive image from such a negative image, although the steps from charging the photosensitive member up to exposing to the optical image are conducted in the same way as in the above described positive-to-positive image formation, toner with charges of the same polarity as that of the charges for the main charging is used for development of the electrostatic latent image, whereby the toner is adhered to the portion that has been exposed to the optical image. And the toner image is transferred onto recording paper while the charge of the reverse polarity to the main charging is provided by a transfer charger.

Thus, it sometimes occurs that electrical charges of the reverse polarity to that of the charges for the main charging are applied to the photosensitive member from the transfer charger at the time of the image transfer, and this causes fogs or the like in the picture image. More specifically, the portion applied with the charges of the reverse polarity to that of the main charging will not reach a specific charged level when the same is subjected to the next main charging, and therefore, the toner tends to adhere this portion on account of the development bias voltage in the reverse development thus causing fogs in the picture image.

To cope with the above mentioned problem, measures such as AC charge-elimination have so far been adopted, in which AC charges are applied to the photosensitive member inclusive of the recording paper immediately after a toner image has been transferred to recording paper thereby to remove the electrical charges. By taking such measures the charges on the photosensitive member are virtually neutralized, or brought to the same polarity as that of the main charging, so that adverse influence is not produced at the time of the image formation next time.

When the image forming operation has been finished and the rotation of the photosensitive member is stopped, the burden of the photosensitive member is lightened by eliminating the charges on the photosensitive member by such means as light erasing to bring its surface potential virtually to zero potential.

In that case, if there are left any small amount of charges, which are of the reverse polarity as that of the main charging, they cause lowering of the charged potential when the photosensitive member is charged in the image forming operation next time.

In the image forming apparatus of this type in general, the transfer charger for transferring a toner image on the photosensitive member to recording paper and the AC charge-eliminator which becomes operative immediately after the transfer has been made are integrally formed side by side and their operations are controlled as if they were an integral body. Therefore, when the photosensitive member stops its rotation after the image forming operation has been finished, both the transfer charger and the AC charge-eliminator stop their operations simultaneously.

Therefore, when the photosensitive member stops its operation, there remains on the photosensitive member such a portion that is charged subjected to the action of the transfer charger and yet not subjected to the action of the AC charge-eliminator, and from this, it follows that some charges of the reverse polarity to the main charging remain locally on the photosensitive member.

In order to eliminate such residual charges, it has so far been required to subject the photosensitive member to charging by the main charger and to light erasing by rotating the photosensitive member additional turns after the image forming operation has been finished—the operation being the rotations of the photosensitive member after the completion of the image formation is called the "postrotation". Also, in an image forming apparatus including no AC charge-eliminator, the practice of the post-rotation has been required to eliminate the residual charges.

However, since the post-rotation causes wear of the photosensitive member as well as decrease and fatigue of the photosensitivity of the photosensitive member and therefore shortens the life of the photosensitive member, it has been desired that the post-rotation may be reduced as much as possible.

SUMMARY OF THE INVENTION

Accordingly, the main object of the present invention is to provide an electrostatic image forming apparatus capable of reducing wear of the photosensitive member.

Another object of the invention is to provide an electrostatic image forming apparatus capable of reducing decrease and fatigue of the sensitivity of the photosensitive member.

These and other objects are achieved by an electrostatic image forming apparatus which comprises rotatable photosensitive member formed of a P-type or N-type semiconductor, charging means including a wire electrode for charging the photosensitive member and a grid electrode for controlling the potential thereon, exposure means for forming an electrostatic latent image on the charged photosensitive member, means for developing the electrostatic latent image using toner of the same polarity as that of the electrostatic latent image, transfer means for electrostatically transferring the toner image formed on the photosensitive member to recording medium, means for varying the voltage applied to the grid electrode of the charging means, and means for controlling the voltage on the grid electrode of the charging means so that the charged potential on the photosensitive member may be shifted virtually at zero potential after the completion of the image forming operation.

These and other objects, advantages and features of the invention will become apparent from the following description thereof taken in conjunction with the accompanying drawings which illustrate a specific embodiment of the invention.

DETAILED DESCRIPTION OF THE PREFERRED EMBODIMENTS

Figure 1A:
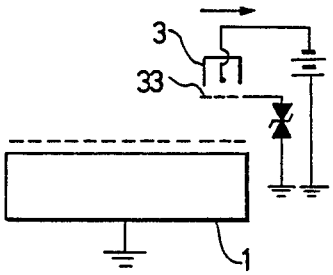
FIGS. 1(*a*) to 1(*f*) are explanatory drawings of a charge control process according to the present invention.
Figure 1B:
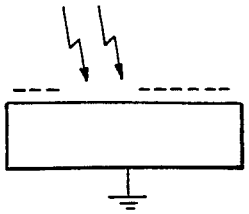
Figure 1C:
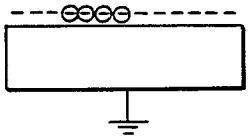
Figure 1D:
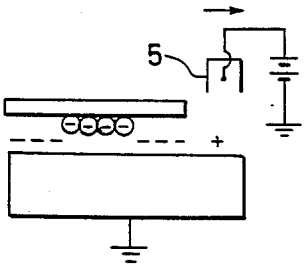
Figure 1E:
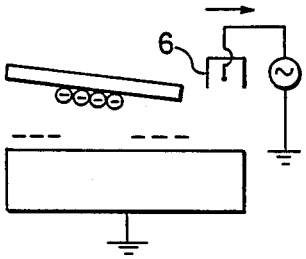
Figure 1F:
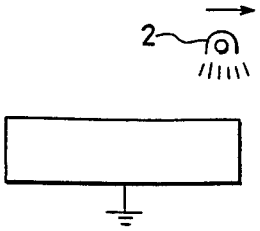
Figure 2A:
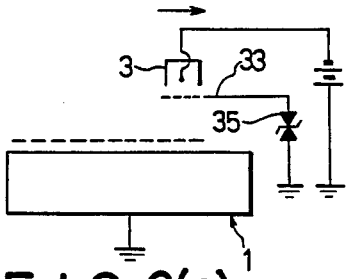
FIGS. 2(*a*) to 2(*h*) are explanatory drawings of the control process executed upon completion of the image forming operation according to the present invention.
Figure 2B:
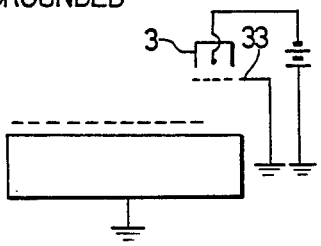
Figure 2C:
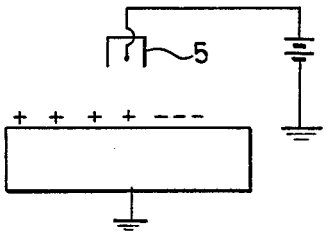
Figure 2D:
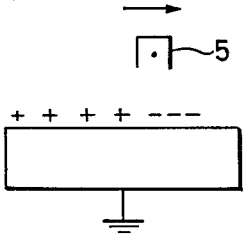
Figure 2E:
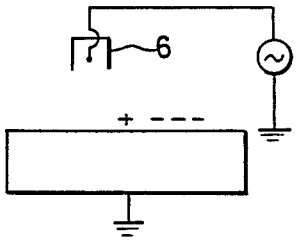
Figure 2F:
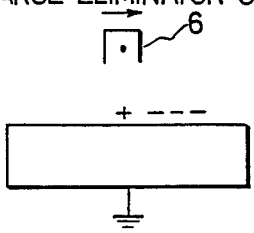
Figure 2G:
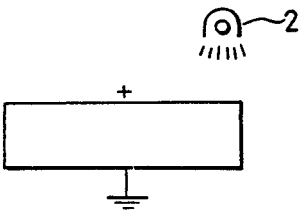
Figure 2H:
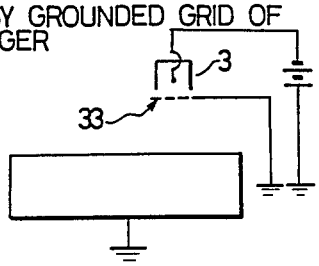

Description will first be made about changes in charged conditions of the photosensitive member caused by the charge control device included in the image forming apparatus of the present invention with reference to schematic drawings shown in FIGS. 1 and 2. The process is performed in the order of (a) to (f) in FIG. 1 and (*a*) to (*h*) in FIG. 2. The arrows in the drawings indicate the direction of movement relative to the photosensitive member of the members acting thereon such as, for example, the main charger.

FIG. 1 schematically shows the steps in the ordinary image forming process from charging to erasing by light. In FIG. 1(a), photosensitive member 1 is negatively charged by main charger 3. Here, as the main charger 3, a charger with control grid 33 is used in the present invention. FIG. 1(*b*) shows the state of the photosensitive member exposed to light, whereby its charges are dissipated at the portion irradiated by the light. FIG. 1(*c*) shows the state of the same developed with toner having electrical charges of the same polarity as that of the charges for the main charging, whereby the toner of negative polarity is adhered to the portion irradiated by the light. FIG. 1(*d*) shows the state of the same from which the toner is transferred to recording paper by transfer charger 5 providing positive charges, whereby the portion on the photosensitive member excluding the portion opposite to the recording paper is positively charged by the transfer charger 5. FIG. 1(*e*) shows the state of the same whose charges are eliminated by AC charge-eliminator 6, and thereby, while the charges on the recording paper are erased to separate from the photosensitive member, the positive charges on the portion of the photosensitive member excluding the portion opposite to the recording paper are also erased. FIG. 1(*f*) shows the state of the photosensitive member from which the residual negative charges are also erased by erasing lamp, whereby the electric potential all over the surface of the photosensitive member becomes virtually zero.

On the other hand, FIG. 2 schematically shows the steps from charging up to erasing of electricity upon completion of the image forming operation.

First, as shown in FIG. 2(*a*), the photosensitive member 1 is negatively charged by the main charger 3. The grid 33 of the main charger 3 is then grounded as shown in FIG. 2(*b*), whereby the potential on the portion of the photosensitive member passing under the main charger 3 becomes virtually zero. FIG. 2(*c*) shows the state of the photosensitive member positively charged when the same is passing under the transfer charger 5, and FIG. 2(*d*) shows the state when the transfer charger 5 is turned OFF. In FIGS. 2(*c*) and 2(*d*), the negative charges remaining on the photosensitive member are charges on that portion of the photosensitive member which have passed under the grid 33 of the main charger 3 before the grid 33 was grounded in FIG. 2(*b*). FIG. 2(*e*) shows the state of the photosensitive member from which positive charges were eliminated by the AC charge-eliminator 6. FIG. 2(*f*). shows the state of the photosensitive member with some positive charges remaining thereon because the transfer charger 5 and AC charge-eliminator 6 were simultaneously turned OFF. FIG. 2(*g*) shows the state of the photosensitive member subjected to the charge erasing by the erasing lamp 2, whereby negative charges were erased but the positive charges are still remaining. FIG. 2(*h*) shows the state of the photosensitive member whose portion where the residual positive charges had been present was moved to the portion under the grounded grid 33 of the main charger 3, whereby the positive charges were erased and hence the potential all over the surface of the photosensitive member has been brought to virtually zero potential.

As described above, by controlling the potential of the control grid 33 of the main charger 3 for predetermined time after the image forming operation has been finished, the potential on the surface of the photosensitive member can be brought virtually to zero potential.

Figure 3:
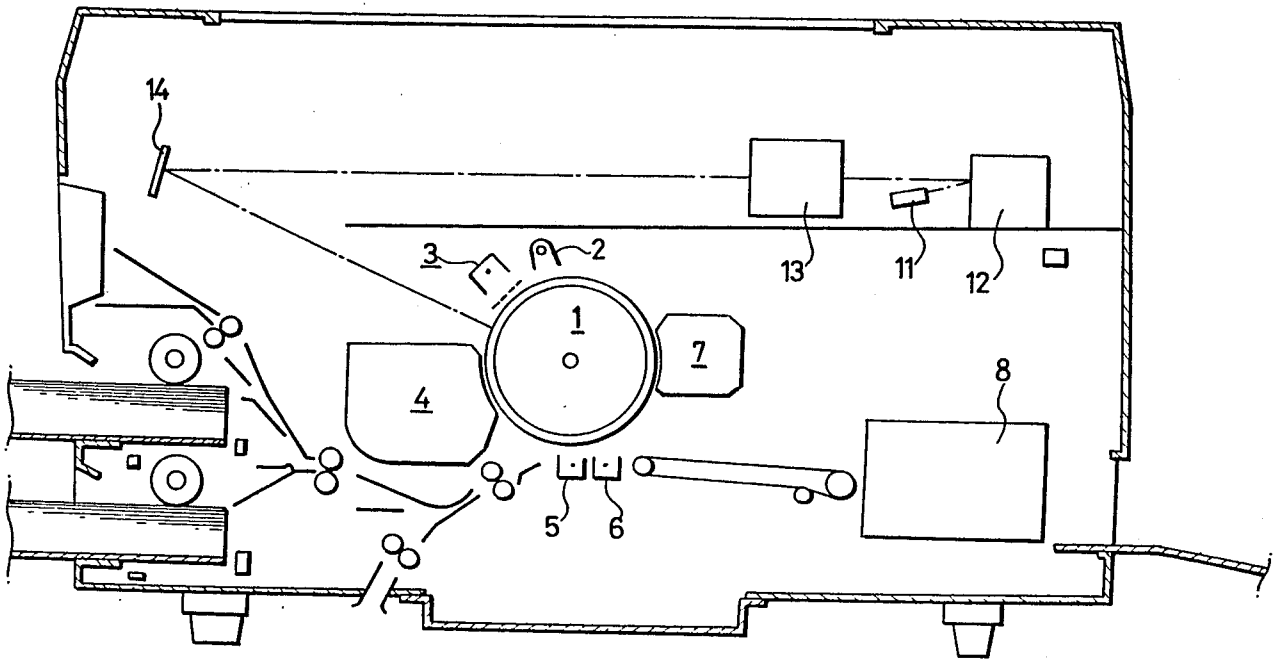
FIG. 3 is a transverse sectional view of a laser printer to which the present invention is applied.

FIG. 3 shows a laser printer to which the present invention is applied. Referring to the figure, reference numeral 1 denotes a photosensitive member, 2 denotes an erasing lamp, and 3 denotes a main charger provided with a control grid 33 as described later. Reference numeral 4 denotes a developing device, 5 denotes a transfer charger, 6 denotes an AC charge-eliminator, 7 denotes a cleaner, 8 denotes a fixing device, 11 denotes a laser beam oscillator, 12 denotes a polygon mirror, 13 denotes a lens, and 14 denotes a mirror.

The laser beam generated by the laser beam oscillator 11 is modulated based on recording information transmitted from a data processing apparatus, not shown, and introduced through a scanning optical system consisting of the polygon mirror 12, lens 13, and the mirror 14 to the photosensitive member 1 to form thereon an electrostatic latent image of the recording information. The thus formed electrostatic latent image is processed through the steps of development, transfer, and fixing and printed on recording paper.

Figure 4A:
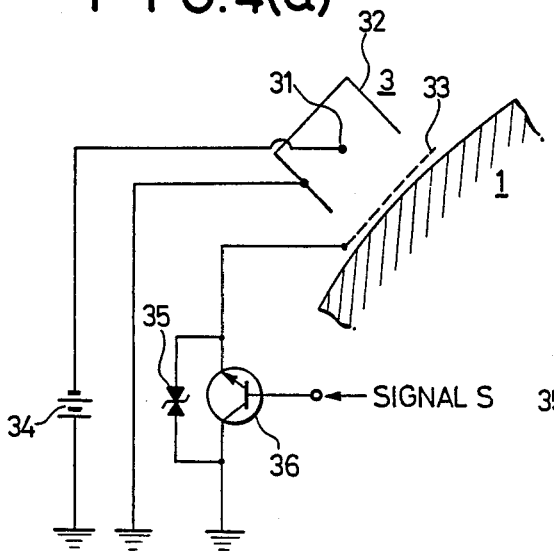
FIGS. 4(*a*) and 4(*b*) are drawings showing structure and circuit of a main charger.
Figure 4B:
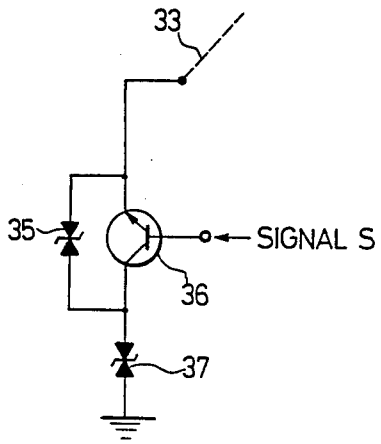

The main charger will now be explained. FIG. 4(*a*) is a drawing showing basic structure of the main charger and an operating circuit therefor, wherein the main charger 3 comprises a charging wire 31 disposed along the surface of the photosensitive member 1 and elongated in the direction of its axis of rotation, stabilizing plate 32 covering the charging wire 31, and a grid 33 disposed between the charging wire 31 and photosensitive member 1 and adjacent to the surface of the photosensitive member. Reference numeral 34 is the power source for the main charger applying a high voltage to the charging wire 31. The stabilizing plate 32 is grounded and the control grid 33 is grounded through a varistor 35, and the varistor 35 is provided with a transistor 36 connected in parallel therewith.

When the electric power is applied to the charging wire 31 and the photosensitive member 1 is thereby charged, the surface potential of the photosensitive member 1 is held stabilized at the grid potential to be determined by the value of the varistor 35 if a signal S is not supplied to the base of the transistor 36 and it remains in nonconductive state. When the signal S is supplied to the base of the transistor 36, then the transistor 36 is turned to conductive state and the control grid 33 is grounded, and the surface potential of the photosensitive member 1 becomes virtually zero potential.

It is generally practiced that the developing bias voltage is held at zero potential during the time of the post-rotation. Accordingly the surface potential of the photosensitive member 1 may be held at higher potential by inserting a varistor 37 between the transistor 36 and the ground as shown in FIG. 4(*b*) in order to prevent toner adhering.

Figure 5:
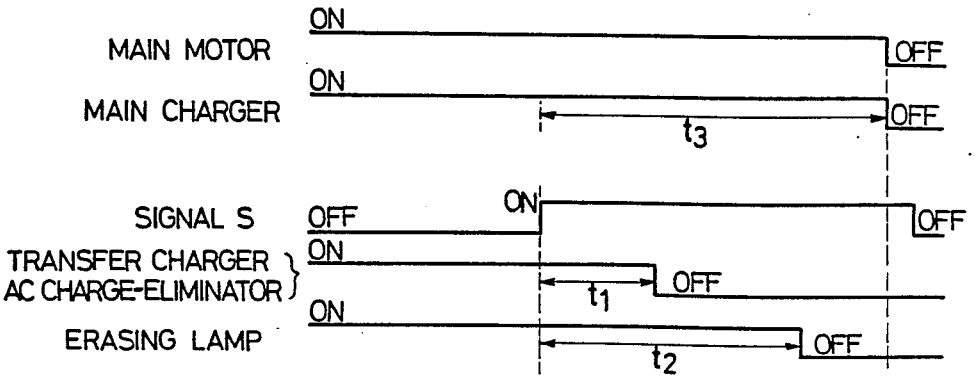
FIG. 5 is a timing chart for explaining timing in charge control.

Now, the charge control after the image forming operation has been finished will be described with reference to FIG. 2, FIG. 4, and the timing chart after the completion of the image forming operation as indicated in FIG. 5.

By the way, in the present embodiment, the timing at which the image forming operation has been finished means the timing at which the formation of the electrostatic latent image on the photosensitive member by the scanning of optical system including the laser beam oscillator 11 has been finished.

During the image forming operation, the control grid 33 of the main charger 3 is grounded through the varistor 35 as shown in FIG. 2(*a*), and therefore, the photosensitive member is charged so as to be held at the same potential as the grid potential.

Upon the completion of the image forming operation, the signal S is issued to the base of the transistor 36 from a control circuit not shown, whereby the transistor 36 is turned to conductive state and the control grid 33 is grounded (refer to FIG. 2(*b*)). The surface potential of the portion of the photosensitive member opposing to the control grid 33 becomes virtually zero potential.

The photosensitive member 1 continues to rotate whereby the portion charged to the negative polarity by the main charger 3 is charged to reverse polarity by the transfer charger 5. Meanwhile, the transfer charger 5 and AC charge-eliminator 6 are controlled to stop their operations after the time period $t_1$ elapsed from the time when the signal S has been issued, which is slightly shorter than the time period that is required for the rear end of the portion of the photosensitive member charged to the negative polarity by the main charger to pass the transfer charger 5 (refer to FIGS. 2(*c*), (*d*), (*e*), (*f*) and FIG. 5). Thus, there is left a portion on the photosensitive member 1, that has been positively charged by the transfer charger 5 but has not been eliminated by the AC charge-eliminator 6. Also, since the transfer charger 5 and AC charge-eliminator 6 stop their operations after the time period $t_1$ shorter than the time period required for the rear end of the portion of the photosensitive member charged by the main charger 3 have passed the transfer charger 5, there remain a part of the negative charges charged by the main charger 3 on the photosensitive member 1. Such arrangements are made in order that the charging of the reverse polarity by the transfer charger is made as small as possible.

While the photosensitive member 1 further continues to rotate, the portion with the above described residual negative charges thereon is brought to the position under the erasing lamp 2, and thereby, the negative charges are erased but there still remains the portion with the above described residual positive charges thereon. The erasing lamp stops its operation after the time period $t_2$, i.e., when the negative charges are erased (refer to FIG. 2(*g*) and FIG. 5).

The photosensitive member keeps on rotating, and when the portion with the residual positive charges thereon comes to the position under the main charger 3, the positive charges on the photosensitive member are erased, because the grid 33 of the main charger 3 is grounded. Accordingly, the potential on the surface of the photosensitive member becomes virtually zero potential. (Refer to FIG. 2(*h*) and FIG. 5.)

The main charger 3 stops its operation at this point, and its time period $t_3$ is the time required for the rotation only slightly exceeding the full one rotation of the photosensitive member after the signal S has been issued for grounding the control grid 33 of the main charger 3.

Although the transistor 36 is used for grounding the grid 33 of the main charger 3 in the above described embodiment, a relay may be used instead of the transistor. And, instead of the varistor, another power supply may be used.

Although the timing at which the image forming operation has been finished is taken at the timing when an electrostatic latent image has been formed on the photosensitive member in the above described embodiment, the timing of the completion of the image forming operation can be taken at the timing of the completion of the transfer of the image to the recording paper or at the timing when the transfer charger has been turned OFF. This is because the present invention is enabled to erase the residual charges of the reverse polarity on the photosensitive member charged by the transfer charger 5 to zero potential with the use of the main charger 3 having the control grid 33.

While the AC charge-eliminator 6 is in operation, the charges of the reverse polarity produced by the transfer charger 5 are eliminated by this AC charge-eliminator 6, then, when both the transfer charger 5 and AC charge-eliminator 6 are simultaneously turned OFF, the charges of the reverse polarity will only be existing on a very small portion of the photosensitive member which is then opposing the transfer charger 5. Therefore, the erasing of the charges of the reverse polarity can be achieved by applying zero voltage to the control grid 33 only when the above mentioned very small portion of the photosensitive member comes to the position opposite to the main charger 3.

Further, although the wire 31 has been supplied with a D.C. voltage in the above described embodiment, it can be supplied with A.C. voltage.

According to the present invention as described above, the residual charges on the photosensitive member of the reverse polarity to the polarity of the main charging affected adversely to the image formation in reverse developing can be erased not requiring the post-rotation, i.e., continued rotations of the photosensitive member after the image formation process has been finished, but by only one rotation of the photosensitive member, and so, the time required for the erasing can be shortened, and the wear of the photosensitive member and the lowering and fatigue of the photosensitivity of the photosensitive member can be reduced, and therefore, the life of the photosensitive member can be prolonged.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. An electrostatic image forming apparatus comprising:

a. rotatable photosensitive member formed of a P-type or N-type semiconductor;

b. charging means including a wire electrode for charging the photosensitive member and a grid electrode for controlling the potential thereon;

c. exposure means for forming an electrostatic latent image on the charged photosensitive member;

d. means for developing the electrostatic latent image using toner of the same polarity as that of the electrostatic latent image;

e. transfer means including a wire electrode for producing a charge of the reverse polarity from a charge given by said charging means for electrostatically transferring the toner image formed on the photosensitive member to a recording medium;

f. means for varying the voltage applied to the grid electrode of the charging means; and g. means for controlling the voltage on the grid electrode of the charging means so that the charged potential on the photosensitive member may be shifted virtually to zero potential from a former potential after the completion of the image forming operation;

h. wherein said charging means, exposure means, means for developing the electrostatic latent image and transfer means are arranged in said order around said photosensitive member.

2. An electrostatic image forming apparatus according to claim 1, wherein the time of the completion of the image forming operation is the timing at which the formation of an electrostatic latent image on the photosensitive member has been finished.

3. An electrostatic image forming apparatus according to claim 1, wherein the time of the completion of the image forming operation is the timing at which the transfer of the toner image formed on the photosensitive member to recording medium has been finished.

4. An electrostatic image forming apparatus according to claim 1, wherein the means for forming electrostatic latent image is formed with a scanning optical system including a laser beam oscillator.

5. An electrostatic image forming apparatus comprising:

a. rotatable photosensitive member formed of a P-type or N-type semiconductor;

b. charging means including a wire electrode for charging the photosensitive member and a grid electrode for controlling the potential thereon;

c. exposure means for forming an electrostatic latent image on the charged photosensitive member;

d. means for developing the electrostatic latent image using toner of the same polarity as that of the electrostatic latent image;

e. transfer means including a wire electrode for producing a charge of the reverse polarity from a charge given by said charging means for electrostatically transferring the toner image formed on the photosensitive member to a recording medium;

f. means for electrostatically separating recording medium attracted to the photosensitive member at the time of the transfer;

g. means for varying the voltage applied to the grid electrode of the charging means; and h. control means for controlling said voltage varying means so that the potential of the grid electrode of said charging means may be shifted to virtually zero potential from a former potential when the portion of the photosensitive member, which was opposing the transfer means at the time said separating means was brought into the inoperative state, arrives at the position opposite to he charging means;

i. wherein said charging means, exposure means, means for developing the electrostatic latent image and transfer means are arranged in said order around said photosensitive member.

* * * * *